US005718197A

United States Patent [19]

Tsunoda et al.

[11] Patent Number: 5,718,197

[45] Date of Patent: Feb. 17, 1998

[54] CYLINDER BLOCK STRUCTURE OF VERTICAL TYPE MULTI-CYLINDER ENGINE

[75] Inventors: Masaki Tsunoda; Yoshimi Watanabe; Tetsu Wada, all of Wako, Japan

[73] Assignee: Honda Giken Kogyo Kabushiki Kaisha, Tokyo, Japan

[21] Appl. No.: 533,964

[22] Filed: Sep. 26, 1995

[30] Foreign Application Priority Data

Sep. 28, 1994 [JP] Japan ..... 6-233136

[51] Int. Cl.[6] ..... F01M 1/00

[52] U.S. Cl. ..... 123/196 W; 123/195 HC

[58] Field of Search ..... 123/196 W, 195 P, 123/195 S, 195 HC

[56] References Cited

U.S. PATENT DOCUMENTS

| | | | |
|---|---|---|---|
| 1,606,424 | 11/1926 | Irgens et al. | 123/196 W |
| 2,456,668 | 12/1948 | Anderson | 123/196 W |
| 4,570,587 | 2/1986 | Watanabe et al. | 123/195 HC |
| 4,688,529 | 8/1987 | Mitadera et al. | 123/195 HC |
| 4,790,273 | 12/1988 | Oguri et al. | 123/195 HC |
| 4,825,825 | 5/1989 | Chino et al. | 123/195 HC |
| 4,881,510 | 11/1989 | Etoh et al. | 123/196 W |
| 5,090,375 | 2/1992 | Hudson | 123/196 W |
| 5,113,818 | 5/1992 | Bonde et al. | 123/196 W |
| 5,163,394 | 11/1992 | Koishikawa et al | 123/196 W |
| 5,388,555 | 2/1995 | Shiomi et al. | 123/195 P |

FOREIGN PATENT DOCUMENTS

| | | | |
|---|---|---|---|
| 63-27083 | 7/1988 | Japan . | |
| 2-211326 | 8/1990 | Japan | 123/196 W |

*Primary Examiner*—David A. Okonsky

*Attorney, Agent, or Firm*—Nikaido, Marmelstein, Murray & Oram LLP

[57] ABSTRACT

A cylinder block of a vertically oriented multicylinder engine includes a cylinder block structure which is configured to support a crankshaft in a vertical orientation. The cylinder block includes a cylinder head mounting surface thereupon, and a plurality of cylinders therein. The plurality of cylinders are configured along horizontal axes. A reinforcing rib or wall is included, with an inclined surface which is inclined with respect to the axes of the cylinders, to ensure that oil which may contact the reinforcing rib flows downward into the crankcase of the engine.

8 Claims, 4 Drawing Sheets

CYLINDER BLOCK STRUCTURE OF VERTICAL TYPE MULTI-CYLINDER ENGINE

BACKGROUND OF THE INVENTION

1. Field of the Invention

The present invention relates to a cylinder block structure of a vertical type multi-cylinder engine provided with a reinforcing rib or wall therein.

2. Description of the Prior Art

There is a known cylinder block structure in which a reinforcing rib is integrally formed in a cylinder block, as disclosed in Japanese Utility Model Publication No. 27083/88.

In the known cylinder block structure, the reinforcing rib of the cylinder block is formed perpendicular to an axial direction of a crankshaft. Therefore, if an engine is used in a state in which the crankshaft is directed in a vertical direction, the reinforcing rib is directed in a horizontal direction. This is disadvantageous in that oil adhered to the reinforcing rib is prevented from flowing downward into the crankshaft.

SUMMARY OF THE INVENTION

The present invention has been accomplished in view of the prior art, and it is an object of the present invention to prevent oil from remaining on the reinforcing rib which is formed inside of the cylinder block.

To achieve the above object, according to the present invention, there is provided a cylinder block structure of a vertical type multi-cylinder engine in which a crankshaft is vertically supported in a cylinder block and a plurality of cylinders including horizontal axes are juxtaposed along the crankshaft, and are supported in the cylinder block. The cylinder block is formed with a reinforcing rib having an inclined wall, the inclined wall being downwardly inclined in the cylinder block toward the crankshaft from the cylinders.

With the above arrangement, droplets of oil scattered inside the cylinder block, which land or flow onto the reinforcing rib are guided by the inclined wall of the reinforcing rib and collected downward.

The above and other objects, features and advantages of the invention will become apparent from the following description of a preferred embodiment taken in conjunction with the accompanying drawings.

BRIEF DESCRIPTION OF THE DRAWINGS

An embodiment of the present invention will now be described with reference to the accompanying drawings, wherein.

DESCRIPTION OF THE PREFERRED EMBODIMENTS

Figure 1:
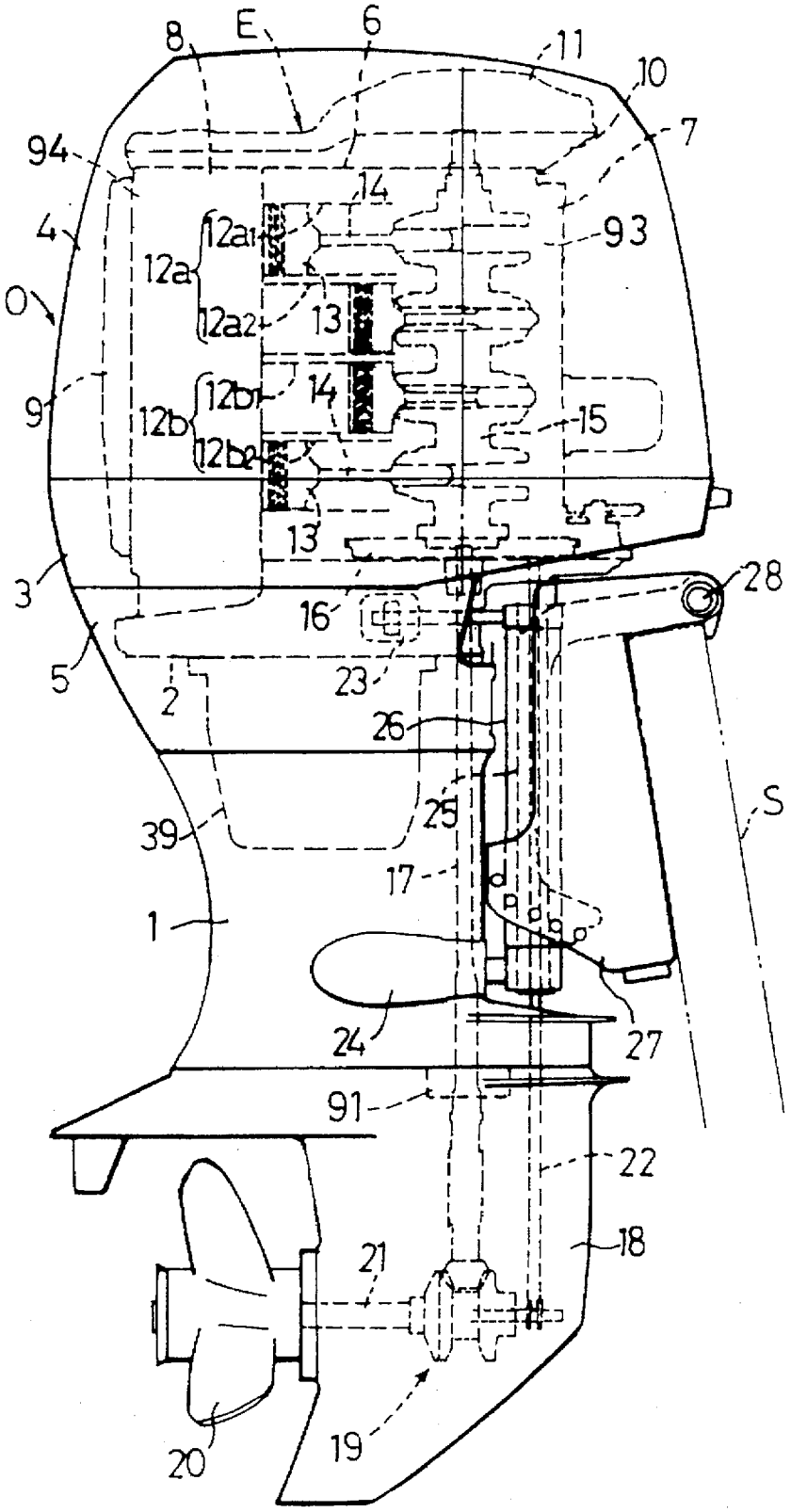
FIG. 1 is a side view of an entire outboard engine with a cylinder block according to one embodiment of the invention.

As shown in FIG. 1, an outboard engine O includes a mount case 2 coupled on an upper portion of an extension case 1. A serial 4-cylinder and 4-cycle engine E is supported on an upper surface of the mount case 2. An under-case portion 3 whose upper surface is opened is coupled to the mount case portion 2. An engine cover 4 is detachably mounted on an upper portion of the under-case portion 3. An under cover 5 is mounted between a lower edge of the under-case 3 and an upper edge of the extension case 1 so as to cover the outside of the mount case portion 2.

The engine E includes a cylinder block 6, a crankcase 7, a cylinder head 8, a head cover 9, a lower belt cover 10, an upper belt cover 11 and an oil pan 39. The cylinder block 6 and the crankcase 7 are supported on an upper surface of the mount case portion 2, and the oil pan 39 is supported on lower surface of the mount case portion 2.

Upper cylinders $12a_1$ and $12a_2$ and lower cylinders $12b_1$ and $12b_2$ are formed in the cylinder block 6, and a piston 13 is slidably fitted in each of these four cylinders. Each of the pistons 13 is connected to a vertically disposed crankshaft 15 through connecting rods 14. The upper two cylinders $12a_1$ and $12a_2$ constitute a first cylinder group 12*a*, and the lower two cylinders $12b_1$ and $12b_2$ constitute a second cylinder group 12*b*.

A drive shaft 17 is connected to a lower end of the crankshaft 15 together with the flywheel 16, and is extended downwardly within the extension case 1. A lower end of the drive shaft 17 is connected to a propeller shaft 21 provided at its rear end with a propeller 20 through a shift gear mechanism 19 provided inside of a gear case 18. A shift rod 22 is connected at its lower end to a front portion of the shift gear mechanism 19 for shifting a rotational direction of the propeller shaft 21.

A swivel shaft 25 is fixed between an upper mount 23 mounted in the mount case portion 2 and a lower mount 24 mounted in the extension case 1. A swivel case 26 rotatably supporting the swivel shaft 25 is vertically swingably supported on a stern bracket 27 mounted on a stern S through a tilt shaft 28.

A structure of the cylinder block 6 will be described below with reference to FIG. 2 to FIG. 4.

The cylinder block 6 includes a cylinder-block-coupling-surface $6_1$ (cylinder head mounting surface) coupled to the cylinder head 8, a crank-case-coupling-surface $6_2$ coupled to the crankcase 7, a mount-case-coupling-surface $6_3$ coupled to the mount case 2, and a cooling-water-cover-coupling-surface $6_4$ to which a cooling water passage cover 47 for defining a cooling water supply passage 51 and a cooling water discharge passage 52 is coupled. The cooling water passage cover 47 is coupled to the cooling-water-cover-coupling-surface $6_4$ of the cylinder block 6 by a bolt 48. The cooling water supply passage 51 is provided at its lower end with a port $51_1$, and a cooling water is supplied through the port $51_1$ to the cooling water supply passage 51 by a water pump 91 (FIG. 1). The cooling water discharge passage 52 is provided at its upper end with a thermostat 92, and at its lower end with a port $52_1$. The cooling water supplied to the cooling water discharge passage 52 through the thermostat 92 is discharged from the port $52_1$.

Figure 4:
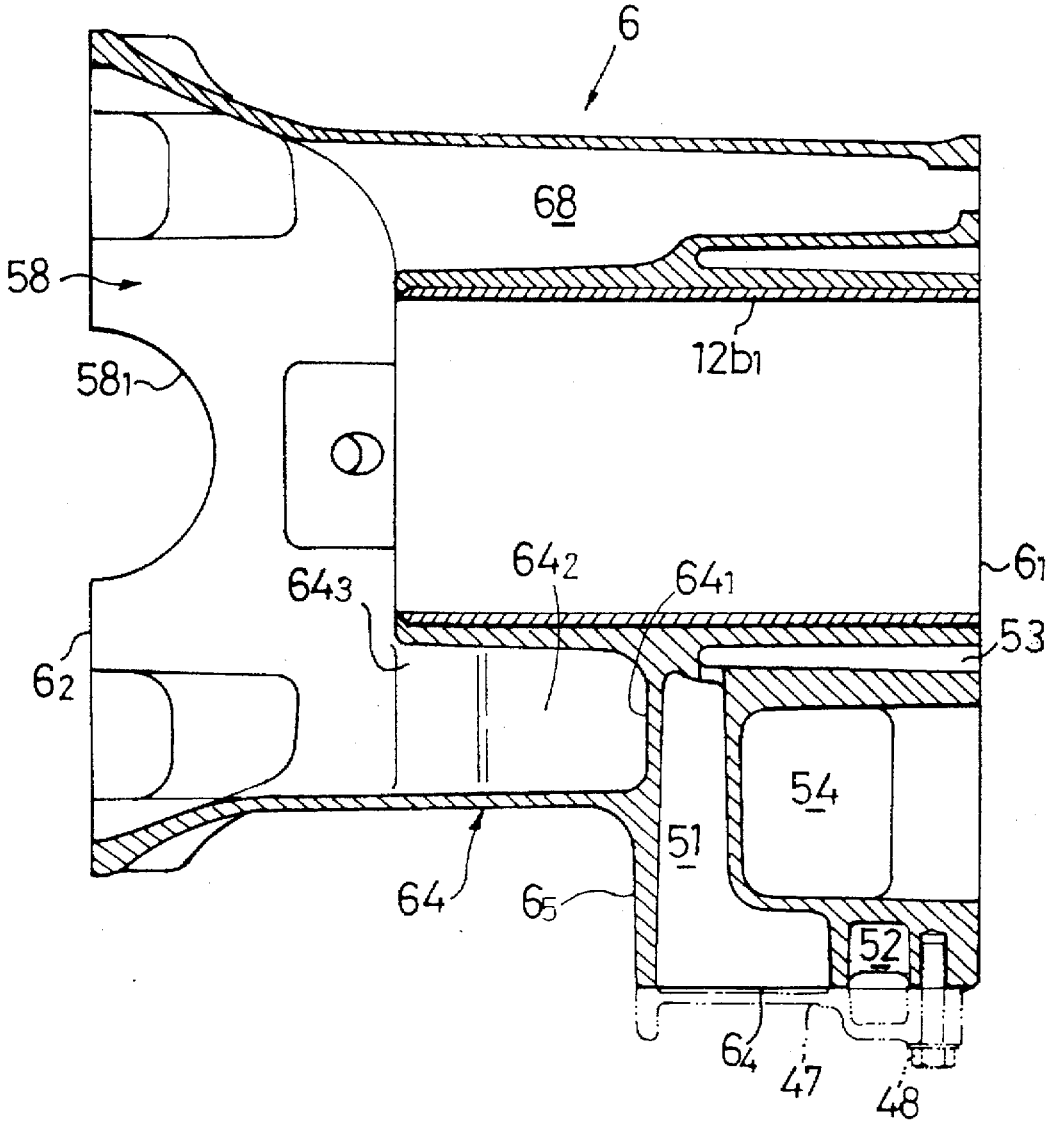
FIG. 4 is a view taken along an arrow 4 of FIG. 2.

As is clear from FIG. 4, the four cylinders $12a_1$, $12a_2$, $12b_1$ and $12b_2$ are formed in the cylinder block 6. These four cylinders $12a_1$, $12a_2$, $12b_1$ and $12b_2$ are juxtaposed or stacked in a vertical direction and each disposed along a horizontal axis. A water jacket 53 is formed around outer peripheries of the cylinders $12a_1$, $12a_2$, $12b_1$ and $12b_2$ so as to open into the cylinder-head-coupling-surface $6_1$. The water jacket 53 is connected to the cooling water supply passage 51. Three surfaces of an exhaust passage 54 formed in the cylinder block 6 are surrounded by the cooling water supply passage 51, the cooling water discharge passage 52 and the water jacket 53. The cooling water supply passage 51, the cooling water discharge passage 52 and the water jacket 53 are formed within a projection $6_5$ formed on a sidewall of the cylinder block 6.

Figure 3:
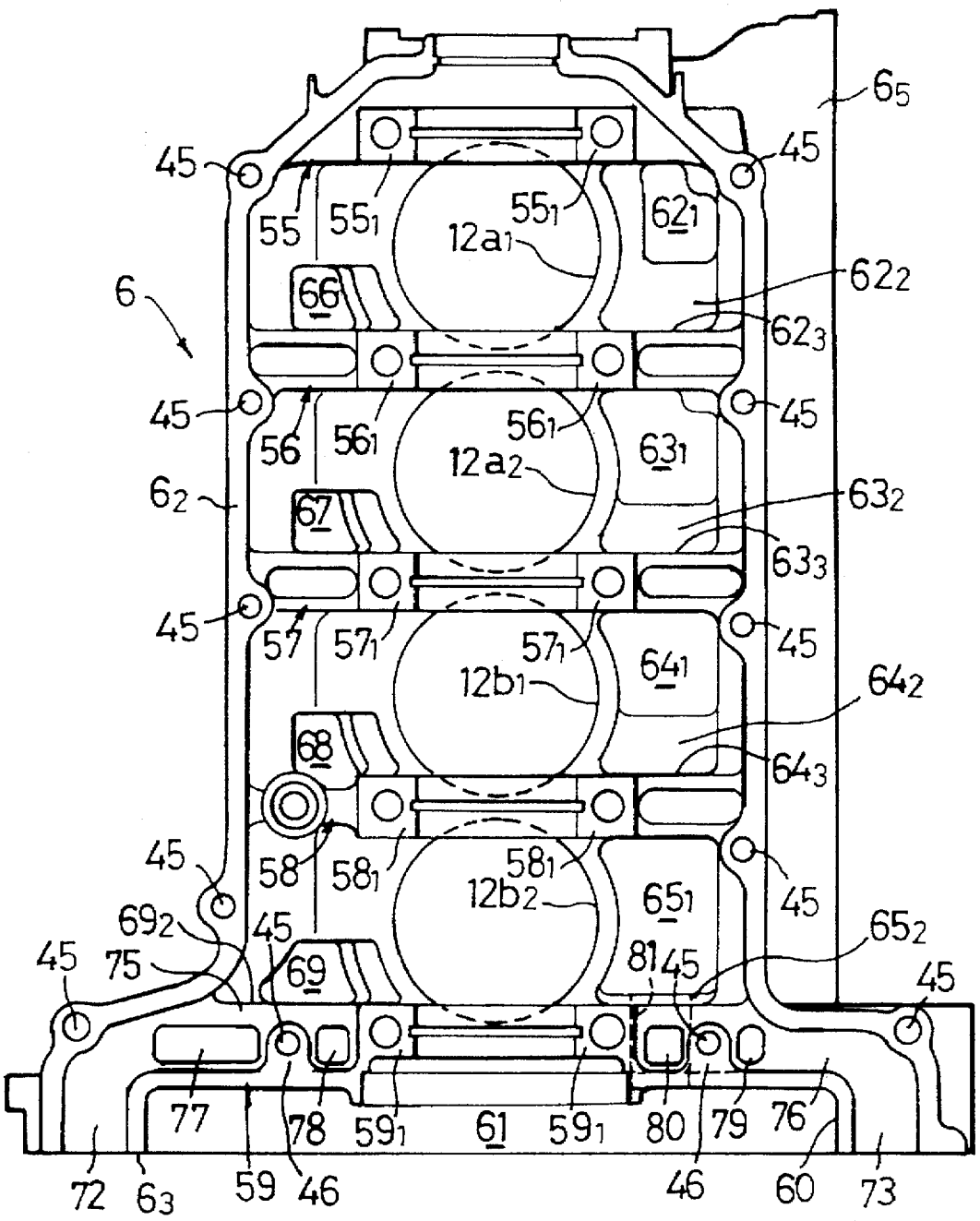
FIG. 3 is a view taken along an arrow 3 of FIG. 2.

As shown in FIGS. 3 and 4, the cylinder block 6 is integrally formed therein with five bearing walls 55 to 59 extending in a horizontal direction. The bearing walls 55 to 59 are provided with semi-circular bearings $55_1$ to $59_1$, respectively, for supporting a journal portion of the crankshaft 15.

As shown in FIG. 3, a lower end of an outer wall of the cylinder block 6 is horizontally projected in a flange-shape, and a dish-like recess 60 is formed at a lower surface of such projection. The recess 60, the crankcase 7 and the mount case portion 2 cooperatively define a flywheel accommodating chamber 61 in which the flywheel 16 is received.

Figure 2:
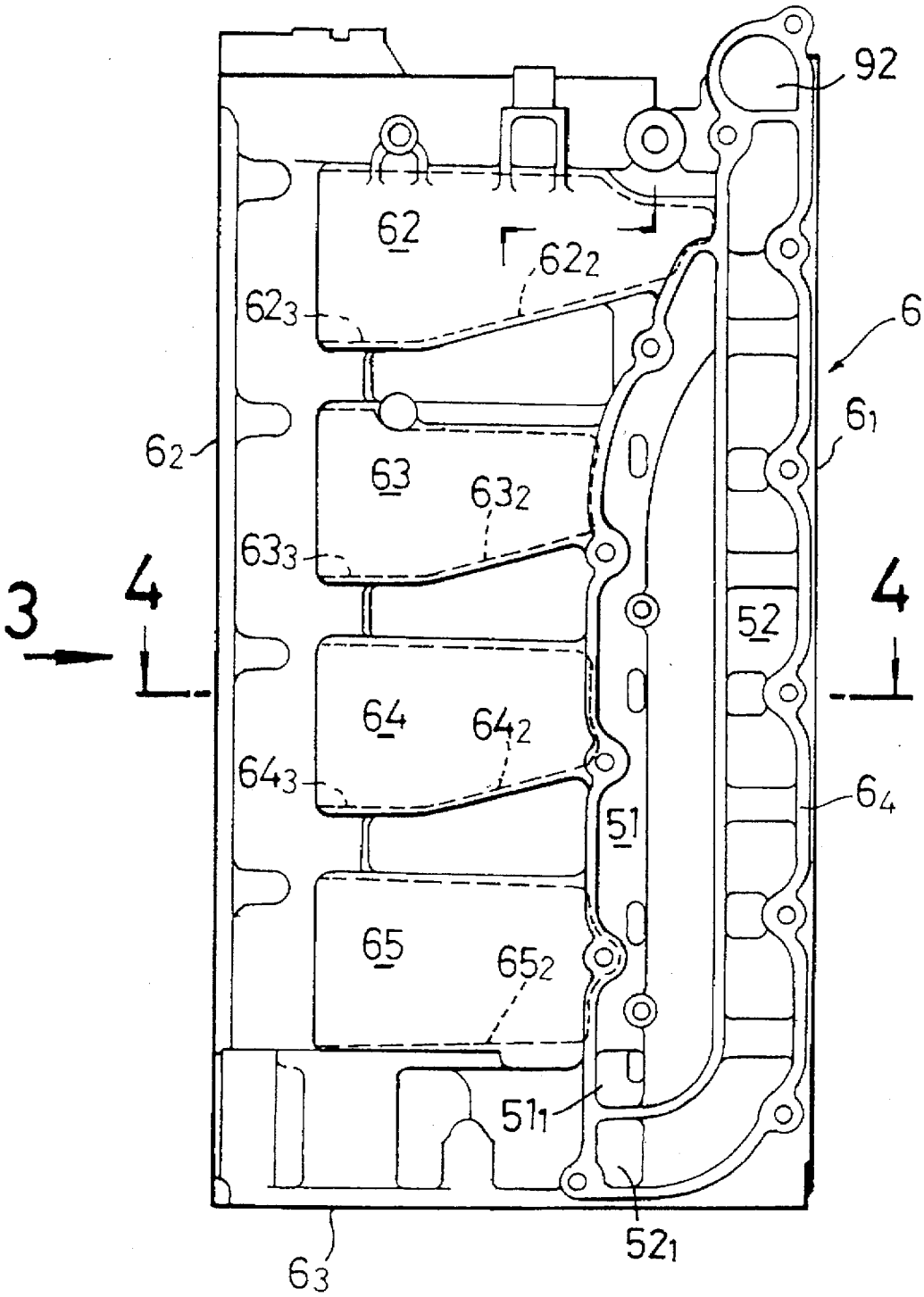
FIG. 2 is a left side view of a cylinder block according to the invention.

As shown in FIGS. 2 and 3, the cylinder block 6 is formed at its left side surface with four reinforcing ribs or walls 62 to 65 extending horizontally from its outer peripheral wall. The reinforcing ribs 62 to 65 constitute box-shaped reinforcing portions, respectively. Referring to FIG. 3, each of the reinforcing portions is surrounded by upper side surfaces, lower side surfaces, left side surfaces (near the center of the cylinder), right side surfaces (near an outer wall of the engine E), and back side surfaces (near the cylinder head 8). The back side surfaces are formed by wall portions of the cooling water supply passage 51. A front side surface (near the crank chamber 93) of each of the reinforcing portion is opened. The cylinder block 6 is formed at its right side surface with four breather passages 66 to 69 which put the crank chamber 93 and a cam chamber 94 into communication with each other.

Cavities or bag-shaped spaces $62_1$ to $65_1$ are formed within the reinforcing ribs 62 to 65, respectively. The cavities $62_1$ to $65_1$ are closed at the side of the cylinder head 8 and opened at the side of the crankcase 7. Inclined walls $62_2$ to $65_2$ are formed at lower surfaces of the cavities $62_1$ to $65_1$, respectively. Further, flat walls $62_3$ to $64_3$ are continuously formed at lower end of the upper three inclined walls $62_2$ to $64_2$. The inclined walls $62_2$ to $65_2$ are downwardly inclined toward the openings of the bag-shaped spaces $62_1$ to $65_1$, i.e., toward upper surfaces of the four bearing walls 56 to 59. The lower ends of the upper three inclined walls $62_2$ to $64_2$ are connected to the bearing walls 56 to 58 through the flat walls $62_3$ to $64_3$, and the lowermost inclined wall $65_2$ is directly connected to the bearing wall 59.

As is clear from FIG. 3, the cylinder block 6 is formed at its lower surface with oil return chambers 72 and 73 so as to surround an outer periphery of the recess 60 which defines the flywheel accommodating chamber 61. The oil return chamber 72 and the oil return chamber 73 are opened into an upper portion of the oil pan 39. A pair of radially extending oil return passages 75 and 76 are formed along a crankcase-coupling-surface $6_2$ of the cylinder block 6. Radially outer ends of the oil return passages 75 and 76 are put into communication with the oil return chamber 72 and 73, respectively.

Further, the crankcase 7 is formed with two boss portions 46 and 46 having bolt bores 45 for check bolts. Two oil return passages 77 and 78 are formed such as to extend perpendicularly with respect to a space or a paper surface of FIG. 3 from one of the boss portion 46. And other two oil return passages 79 and 80 are formed such as to extend perpendicularly with respect to the space or the paper surface of FIG. 3 from the other boss section 46. Outer ends of those four oil return passages 77 to 80 are put into communication with the oil return chamber 72 which is located behind the flywheel accommodating chamber 61, as viewed in FIG. 3. An oil bore 81 is formed in the inclined wall $65_2$ of a lowermost cavity $65_1$ in the vicinity of an outer end of the oil return passage 80. Cavity $65_1$ is put into communication with the oil return chamber 72 through the oil bore 81.

Therefore, a variation in pressure in the crank chamber is modified by volumes of the cavities $62_1$ to $65_1$ of the reinforcing ribs 62 to 65. Even if droplets of oil which spatter by rotation of the crankshaft 15 enter the cavities $62_1$ to $65_1$, the oil is guided to the inclined walls $62_2$ to $65_2$ by gravity and fall downward after flowing down the inclines. The oil then flows through the oil passages 75 to 80 radially outwardly and drops from the oil return chambers 72 and 73 outside the flywheel accommodating chamber 61 into the oil pan 39 and collected therein. Further, oil in the lowermost cavity $65_1$ drops directly into the oil pan 39 from the oil bore 81 formed in the inclined wall $65_2$.

As described above, oil adhered to the cavities $62_1$ to $65_1$ opened into the cylinder block 6 reliably returns to the oil pan 39 and therefore, it is possible to reduce the total amount of oil in the engine.

Although the embodiments of the present invention have been described in detail, it will be understood that the present invention is not limited to the above-described embodiments, and various modifications may be made without departing from the spirit and scope of the invention defined in the claims.

We claim:

1. A cylinder block of a vertically oriented multi-cylinder engine, said cylinder block comprising:

a cylinder block member configured to support a crankshaft in a vertical orientation, and including a cylinder head mounting surface thereupon;

a plurality of cylinders configured in said cylinder block member, said plurality of cylinders having axes extending substantially horizontally;

at least one reinforcing rib, said reinforcing rib and a wall of said cylinders cooperatingly defining a cavity that is formed to extend along the axes of said cylinders and that is open to a crank chamber, said reinforcing rib including an inclined surface which is inclined with respect to the axes of said cylinders.

2. A cylinder block of a vertically oriented multi-cylinder engine, said cylinder block comprising:

a cylinder block member configured to support a crankshaft in a vertical orientation, and including a cylinder head mounting surface thereupon;

a plurality of cylinders configured in said cylinder block member, said plurality of cylinders having axes extending substantially horizontally;

at least one reinforcing rib, said reinforcing rib and a wall of said cylinders cooperatingly defining a cavity that is formed to extend along the axes of said cylinders and that is open to a crank chamber, said reinforcing rib including an inclined surface which is inclined with respect to the axes of said cylinders, wherein said at least one reinforcing rib is a component of a box-shaped reinforcing portion, said box-shaped reinforcing portion defining said cavity and comprising a first end, toward said cylinder head mounting surface, which is closed, a right side, a left side, an upper side, and a lower surface, wherein said lower surface comprises said inclined surface, and wherein a second end of said box-shaped reinforcing portion, opposite from said first end, is opened to said crank chamber, wherein lubricant within the cylinder block can flow from the second end.

3. A cylinder block as recited in claim 2, wherein a width of a cross sectional area of said box-shaped reinforcing portion increases from the closed first end to the opened second end thereof.

4. A cylinder block as recited in claim comprising a plurality of reinforcing ribs or walls.

5. A cylinder block as recited in claim 2, comprising one reinforcing rib or wall corresponding to each of the plurality of cylinders.

6. A cylinder block as recited in claim 1, wherein said inclined surface is configured to guide lubricant toward an interior of the cylinder block, and into a lubricant reservoir.

7. A cylinder block as recited in claim 6, further comprising lubricant guiding means at a lower portion of the cylinder block member, said lubricant guiding means for guiding lubricant into said lubricant reservoir.

8. A cylinder block of a vertically oriented multi-cylinder engine, said cylinder block comprising:

a cylinder block member, in which a crankshaft is vertically supported and a plurality of cylinders including substantially horizontal axes and juxtaposed along said crankshaft are also supported wherein, said cylinder block member is formed with a reinforcing rib, said reinforcing rib and a wall or said cylinders cooperatingly defining a cavity that is formed to extend along the axes of said cylinders and which is open to a crank chamber, said reinforcing rib having an inclined wall, said inclined wall being downwardly inclined in said cylinder block toward said crankshaft from said cylinders.

* * * * *